United States Patent [19]

Austin, deceased et al.

[11] Patent Number: 4,932,564

[45] Date of Patent: Jun. 12, 1990

[54] MULTIPLE FLAVOR POST-MIX BEVERAGE DISPENSING HEAD

[75] Inventors: Forrest L. Austin, deceased, late of Brooklyn Park, Minn.; executrix Willard, Mankato; Jerry A. Long, New Hope, both of Minn.

[73] Assignee: The Cornelius Company, Anoka, Minn.

[21] Appl. No.: 196,413

[22] Filed: May 20, 1988

[51] Int. Cl.[5] ..... B67D 5/56

[52] U.S. Cl. ..... 222/129.1; 222/144.5; 239/470

[58] Field of Search ..... 222/129.1–129.4, 222/132, 144.5, 145, 504; 234/461, 468, 469–470, 398, 407, 432

[56] References Cited

U.S. PATENT DOCUMENTS

| | | | |
|---|---|---|---|
| D. 256,376 | 8/1980 | McKrell | D20/4 |
| 2,371,431 | 3/1945 | DiPietro | 99/323.2 |
| 3,009,653 | 11/1961 | Hedeman | 222/129.4 X |
| 3,396,871 | 8/1968 | McCann | 222/144.5 X |
| 3,455,332 | 7/1969 | Cornelius | 137/604 |
| 3,540,476 | 11/1970 | Fuerst | 137/606 |
| 3,667,724 | 6/1972 | Cornelius | 251/138 |
| 3,800,826 | 4/1974 | McCann | 137/560 |
| 3,966,091 | 6/1976 | Bencic | 222/129.1 |
| 4,218,014 | 8/1980 | Tracy | 239/106 |
| 4,266,726 | 5/1981 | Brown et al. | 239/406 |
| 4,270,673 | 6/1981 | Rodth | 222/129.3 |
| 4,535,917 | 8/1985 | Trewhella | 222/129.1 |
| 4,549,675 | 10/1985 | Austin | 222/129.1 |
| 4,619,378 | 10/1986 | de Man | 222/144.5 |
| 4,658,988 | 4/1987 | Hassell | 222/129.1 |

OTHER PUBLICATIONS

Cornelius Manual 31-6318-000; Apr. 12, 19/8 Pages; Cover, 5, 2, 26, A5, A6, A13, A14 & 29.

McCann's "Two Flavor Faucet", not dated (2 pages), pp. 63 & 64.

*Primary Examiner*—Michael S. Huppert

*Attorney, Agent, or Firm*—Henry C. Kovar

[57] ABSTRACT

A two flavor post-mix carbonated beverage dispensing head has a mounting block and valve body with a treble quick disconnect for water and two syrups, three flow controls in a first triangular structure, three valves and solenoids in a second triangular structure, sonic welded thermoplastic syrup tubes from the flow controls to the valves, and a unique mixing nozzle structure that brings either of the syrups and water convergently together.

20 Claims, 10 Drawing Sheets

MULTIPLE FLAVOR POST-MIX BEVERAGE DISPENSING HEAD

BACKGROUND OF THE INVENTION

1. Field of the Invention

This invention pertains to a multiple flavor post-mix beverage dispensing head having improved structure for selectively combining a single diluent and a selected one of two or more syrups into a beverage.

2. The Prior Art

Multiple flavor post-mix dispensing valves for carbonated beverages are known. Specific examples are as follows.

G. P. McCann U.S. Pat. No. 3,396,871 discloses a two flavor post-mix valve which is being commercialized. This valve has a machined plastic body with a water solenoid and one syrup solenoid on top, and a second syrup solenoid secured kind of as an after thought to the bottom of the valve body. This valve tends to mix syrups and does not provide for quick disconnect removal of the valve body from a dispenser. The single flavor predecessor of this valve is disclosed in G. P. McCann U.S. Pat. No. 3,800,826.

C. V. Di Pietro U.S. Pat. No. 2,371,431 discloses a two flavor post-mix beverage dispensing head which applicants have never seen.

D. A. Hassell U.S. Pat. No. 4,658,988, discloses a single flavor single solenoid post-mix head being converted into a multiple flavor dispensing head, utilizing a remote solenoid valve for the second syrup.

A structure in kit form has been developed that enables the two solenoid dispensing head of U.S. Pat. No. 3,540,476, to dispense either its primary beverage or a second and alternative beverage. This dispensing head has separate solenoids for water and primary syrup. This head is known for dispensing warm drinks because of heat from its dual solenoids. The kit structure includes a secondary syrup valve. The dispensing head is rewired with a bi-stable toggle switch which is flipped to either primary or secondary beverage. When a singular and common actuator lever is depressed, a single switch then opens either the water valve and the primary syrup valve, or only the water valve and the alternate syrup valve. This kit will not work on single solenoid post-mix heads. This kit requires the use of a toggle switch to change from one beverage to another. The toggle switch must be correctly set upon the desired beverage before dispensing is begun.

A third example of a single flavor post-mix valve being converted into a three flavor post-mix valve is an effort by The Cornelius Company of Anoka, Minnesota. This effort pre-dates the previously described efforts and was successfully reduced to practice at least as early as April 12, 1978, but has not been patented in the U.S. or elsewhere. Cornelius manual No. 31-6318-000 of April 12, 1968 documents this effort, which was done on a coin-actuatable cold-cup dispensing machine. This device has a single dispensing head of the type shown in U.S. Pat. Nos. 3,455,332 and 3,667,724. This head, which was originally a single solenoid head, was rebuilt with two solenoids. There was a first solenoid on the water valve and a discrete second solenoid on the syrup valve. A pair of extra syrup lines were run into the nozzle of the dispensing head and each of the extra syrup lines had a discrete normally closed syrup solenoid valve. The electrical controls were a conventional vending machine panel with touch switches. The vending machine is shown in U.S. Design Pat. No. 256,376. The control circuitry would open the dispensing head water valve and syrup valve for the primary beverage, which was usually cola. For the second beverage, the water valve and the syrup solenoid valve in the first extra syrup line would be opened while the dispensing head syrup valve was left closed. For the third beverage, the water valve and the syrup solenoid valve in the second extra syrup line would be opened while the dispensing head syrup valve remained closed.

All of these foregoing devices have a makeshift nozzle that has problems with wash out and with mixing of the different syrups. None of these devices have quick disconnect of the dispensing head from a dispenser. These devices are all large and bulky or require external solenoids and valves to be remotely mounted discrete from the dispensing head.

OBJECTS OF THE INVENTION

It is an object of the present invention to provide a unitized multiple flavor post-mix beverage dispensing head of relatively small size and with efficient packaging and arrangement of components.

It is an object of the present invention to provide a multiple flavor post-mix beverage dispensing head with a unique valve body of welded plastic construction.

It is an object of the present invention to provide a multiple flavor post-mix beverage dispensing head with a bottom cover under the valve body, with the cover having converging and sanitary beverage ports.

It is an object of the present invention to provide a post-mix beverage dispensing valve wherein bottom cover has at least part of the mix chamber as well as water and syrup ports.

It is an object of the present invention to provide a multiple flavor post-mix dispensing head with improved syrup diffusers and deflector for effecting mixing of water and syrup.

It is an object of the present invention to provide a post-mix beverage dispensing head in which a bottom cover is provided with water and beverage ports, a surface of the mix chamber and mix nozzle support and seal structure.

SUMMARY OF THE INVENTION

According to the principles of the present invention, a multiple flavor post-mix beverage dispensing head has a valve body with a water port and a pair of syrup ports, normally closed valve elements in each port, a single mixing nozzle, with the valve elements and discrete valve solenoids being in a triangular structure above the nozzle.

A multiple flavor post-mix beverage dispensing head has a valve body with water and syrup ports, a single nozzle, and at least two of the ports on the outside of the body and enclosed by initially discrete tunnel covers permanently welded to the body.

A multiple flavor post-mix beverage dispensing head has a valve body with water and syrup ports leading to outlets, a normally closed valve element in each port, a bottom cover mounted to the body, the cover has a bottom skirt and generally vertical discrete water and syrup outlet ports and nozzle securing structure, outlet seals sealing the cover outlet ports to body outlets, and a mixing nozzle secured to the bottom cover.

A post-mix beverage dispensing head having a valve body with water and syrup ports leading to outlets, a normally closed valve in each port, a bottom cover mounted to the body with the cover having a generally planar bottom skirt covering the underside of the body and generally vertical and discrete water and syrup outlet ports fluidly connected to the body and a mix chamber upper surface, outlet seals between the cover and the body, and a mixing nozzle secured to the bottom cover.

A multiple flavor post-mix beverage dispensing head with a body, water and syrup ports, normally closed valves in the ports and a mixing nozzle has the improvement of a pair of generally vertical syrup outlet ports extending downward into the nozzle in off-center positions, a syrup diffuser at the end of each outlet port, and a syrup deflector surface in each diffuser with the deflector surfaces being focused upon respective far sides of the nozzle.

A post-mix beverage dispensing head with a body, water and syrup ports, valve elements in each port and a mixing nozzle has an improved syrup diffuser within the nozzle, the diffuser has a generally vertical outlet port and a syrup diffuser plug at the outlet end of the outlet port and outwardly sloped syrup deflector surfaces on the plug, and the deflector surfaces from a syrup outlet into the nozzle.

A multiple flavor post-mix beverage dispensing head has a valve body with a water port and a pair of syrup ports, a normally closed valve element in each port, a single mixing nozzle, a guide pin on the back of the valve body and above water and syrup inlets into the body, a quick disconnect mounting block having a complementary water and a pair of syrup outlets fluidly connectible to the body inlets and a lock on the top side of the block for engaging and locking to the guide pin, and structure on the underside of the valve body and mounting block for latching the body to the block.

Many other advantages, features and additional objects of the present will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
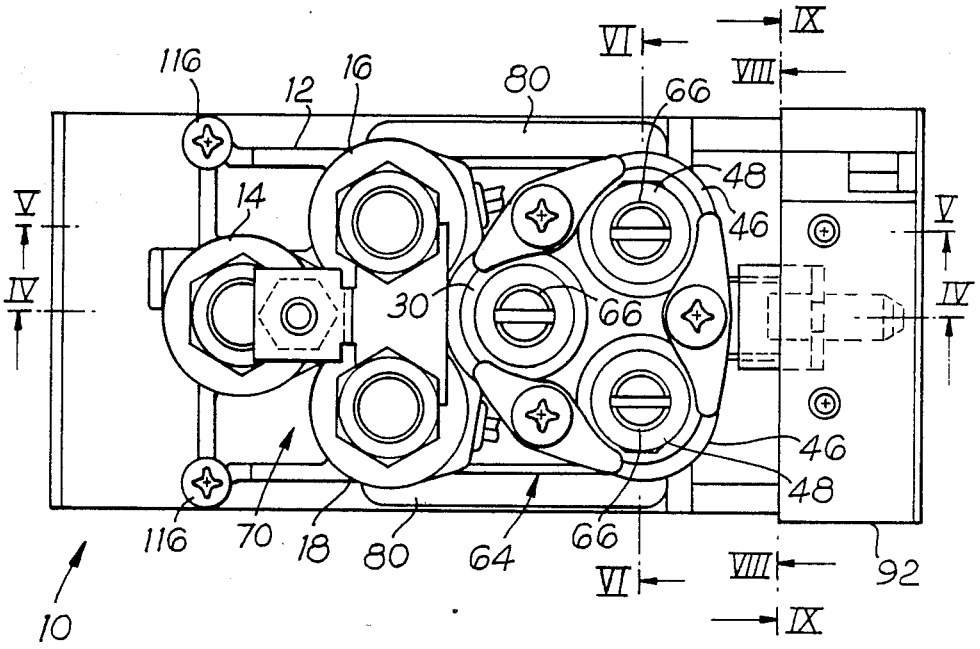
FIG. 1 is a top plan view of the preferred embodiment of a multiple favor post-mix carbonated beverage dispensing head according to the present invention, with the top cover being taken off.
Figure 2:
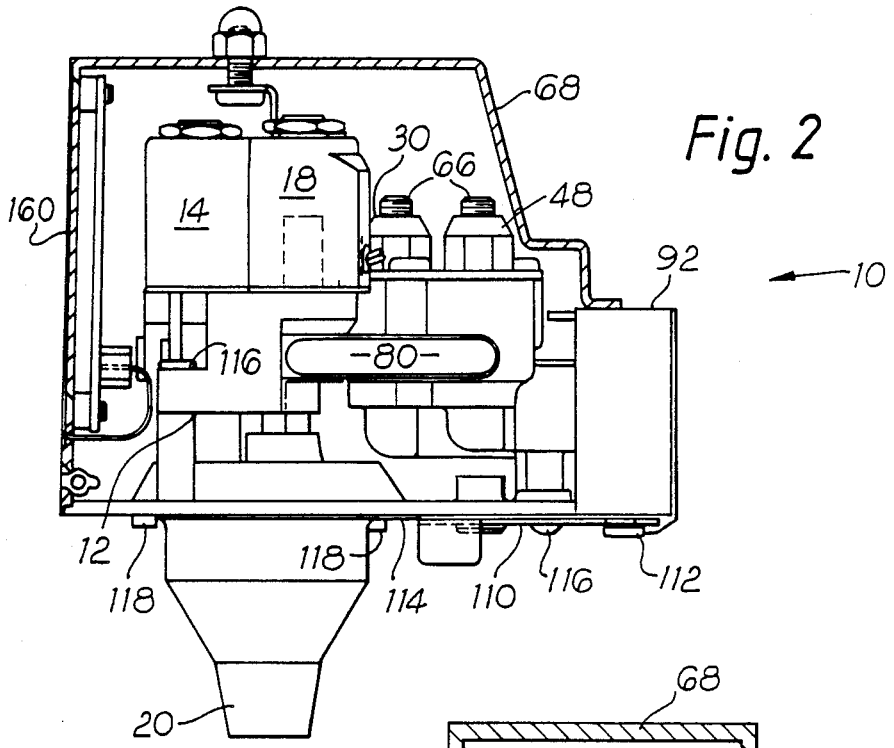
FIG. 2 is a side elevational view of the structure of FIG. 1, with the top cover being sectioned.
Figure 3:
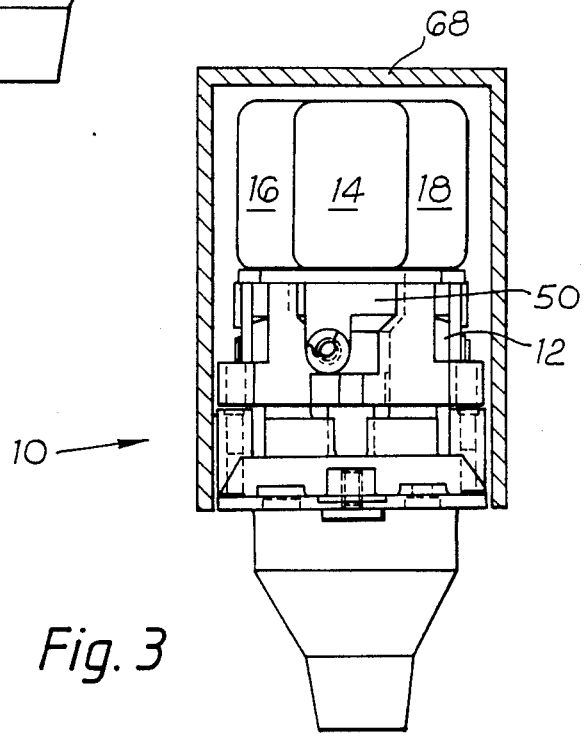
FIG. 3 is front elevational view of the structure of FIG. 1, with the cover being sectioned.

A multiple flavor post-mix beverage dispensing head according to the principle of the present invention is shown in FIGS. 1–3 and generally indicated by the numeral 10, and is herein after referred to simply as the "head 10". The head 10 as shown has a valve body 12, a water solenoid 14, at least two discrete syrup solenoids 16, 18 and a dispensing nozzle 20. The head 10 as shown is specifically for dispensing cold carbonated water, and/or one of two beverages combining carbonated water and either a first or second beverage syrup respectively, all out of the single nozzle 20.

Figure 4:
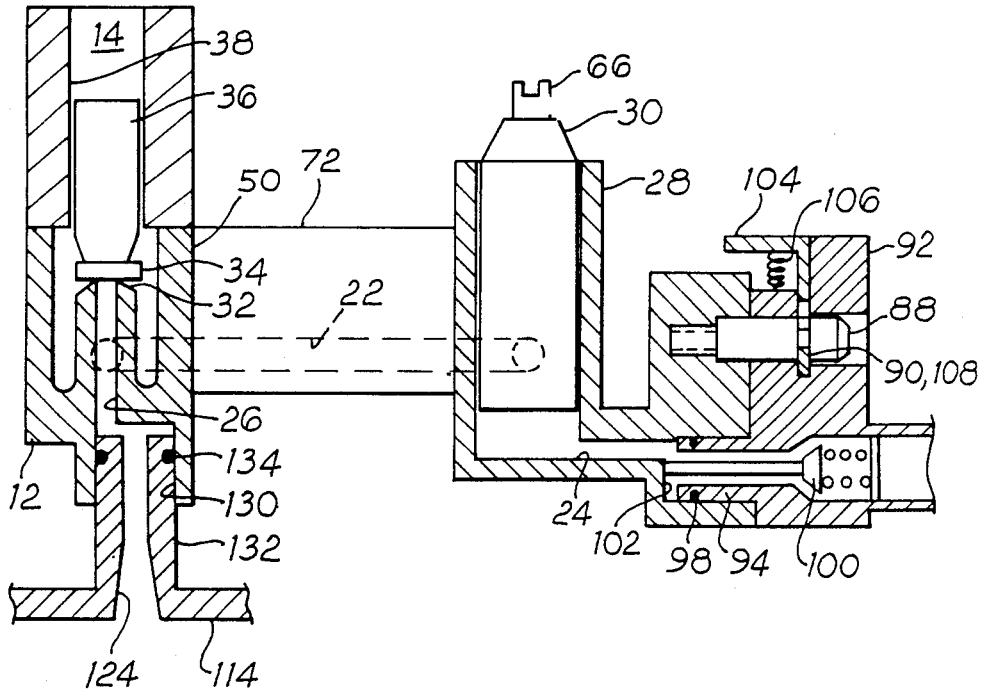
FIG. 4 is an elevational view in section of the structure of FIG. 1 through lines IV—IV.

The thermoplastic valve body 12, as best shown in FIG. 4 has a water port 22 extending from a water inlet 24 to a water outlet 26 above the nozzle 12. Just downstream of the water inlet 24 is a body housing 28 for a water volumetric flow rate control 30 which may be of the adjustable piston and sleeve type or of the fixed elastomeric washer type. Both types of water flow controls are conventional and well known. Downstream of the flow control 30 is a water valve seat 32 which is normally closed by an elastomeric water valve 34 connected to a solenoid plunger 36 surrounded by a solenoid coil 38 mounted on the body 12. The water valve seat 32 is in a discrete water valve housing 50 spaced from the flow control housing 28.

Figure 5:
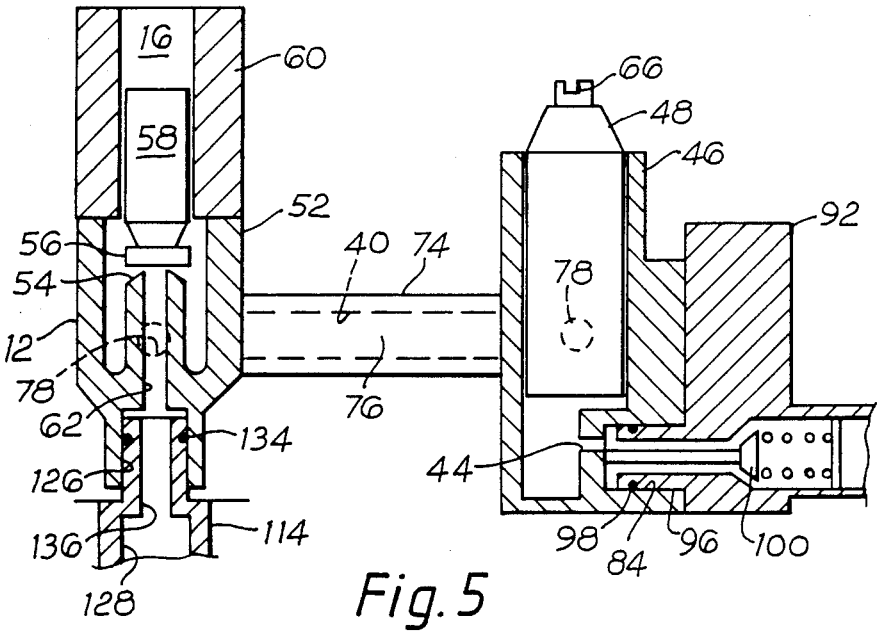
FIG. 5 is an elevational sectioned view of the structure of FIG. 1 through lines V—V.
Figure 6:
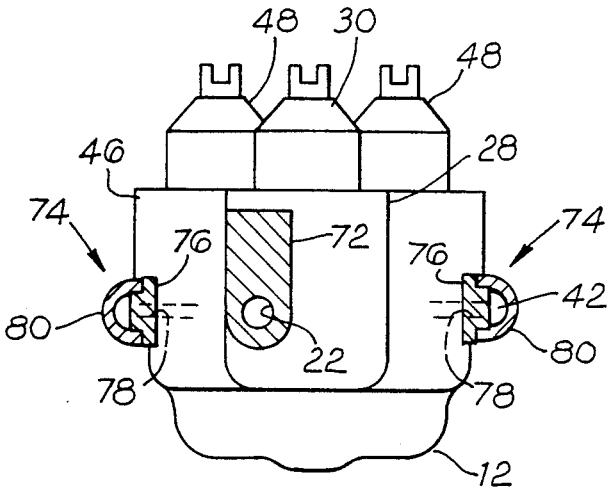
FIG. 6 is an elevational sectioned view of the structure of FIG. 1 through lines VI—VI.

The valve body 12 has a pair of syrup ports 40,42 which are one on each transverse side of the body 12 and which are the mirror image of each other as best shown in FIGS. 5 & 6. Each syrup port 40, 42 has a syrup inlet 44 leading to a body having 46 for a syrup volumetric flow rate control 48. Each syrup port 40, 42 then leads to a syrup valve housing 52 having a syrup valve seat 54 normally closed by an elastomeric syrup valve 56 connected to a solenoid plunger 58 within a solenoid coil 60 mounted on the body 12. The syrup port 40 further includes an outlet port 62 leading from the syrup valve 54 to the nozzle 12.

As best shown in FIG. 1, the flow control housings 28, 46, and the flow controls 30, 48 are in a first triangular structure 64 adjacent the back of the valve body 12. The water flow control 30 and its housing 28 are on the center-line of the valve body 12 and are transversely flanked by the syrup flow controls 48 and syrup housings 46. If the flow controls 30, 48 are of the adjustable type, all of the adjustment members 66 face upward and are accessible from above upon removal of the cover 68. The valve housing 50, 52 and solenoids 38, 60 as well as the water and syrup outlets 26, 62 are arranged in a discrete second triangular structure 70 in front of and spaced from the first triangular structure 64. The water housing 50, solenoid 38 and water outlet 26 are on the center-line of the valve body 12 and are directly in front of the water flow control housing 28 and flow control 30. Each of the syrup valve housings 52 and its associated componentry 54–62 is positioned in line with the syrup flow control housings 46 and transversely to the side of the water valve housing 50. The water valve housing 50 is in the front of the second triangular structure 70 just as the water flow control housing 28 is in the front of the first triangular structure 64.

The first and second triangular structures 64, 70 are both isosceles shaped and are commonly molded into the valve body 12, but they are spaced from each other. The second triangular structure 70 is suspended forward of the first triangular structure 64 by a water tube 72 and a pair of syrup tubes 74 through which the syrup ports 40,42 pass. The water tube 72 is molded completely integral with and directly secures the water valve housing 50 to the water flow control housing 46. Each of the syrup tubes 74 has an inside base plate 76 molded integrally in the valve body 12 and directly securing each syrup valve housing 52 to a respective syrup flow control housing 46. On each end of each plate 76 is a transverse bore 78 through and into the respective housing 46, 52. An initially discrete thermoplastic tunnel cover 80 is molded discretely from the valve body 12 and is subsequently permanently solvent or sonic welded to each plate 76 to complete the structure of each syrup tube 74 and fluidly close each syrup port 40, 42. The tunnel covers 80 are on the transverse outside of the valve body 12 and structurally overlap one each on to a respective pair of syrup valve and flow control housings 52, 46 as best seen in FIG. 2. The centrally located water tube 72 forms a central fore-aft structural element in the valve body 12, and each of the syrup tubes 74 forms a side fore-aft structural element of the valve body 12.

Figure 7:
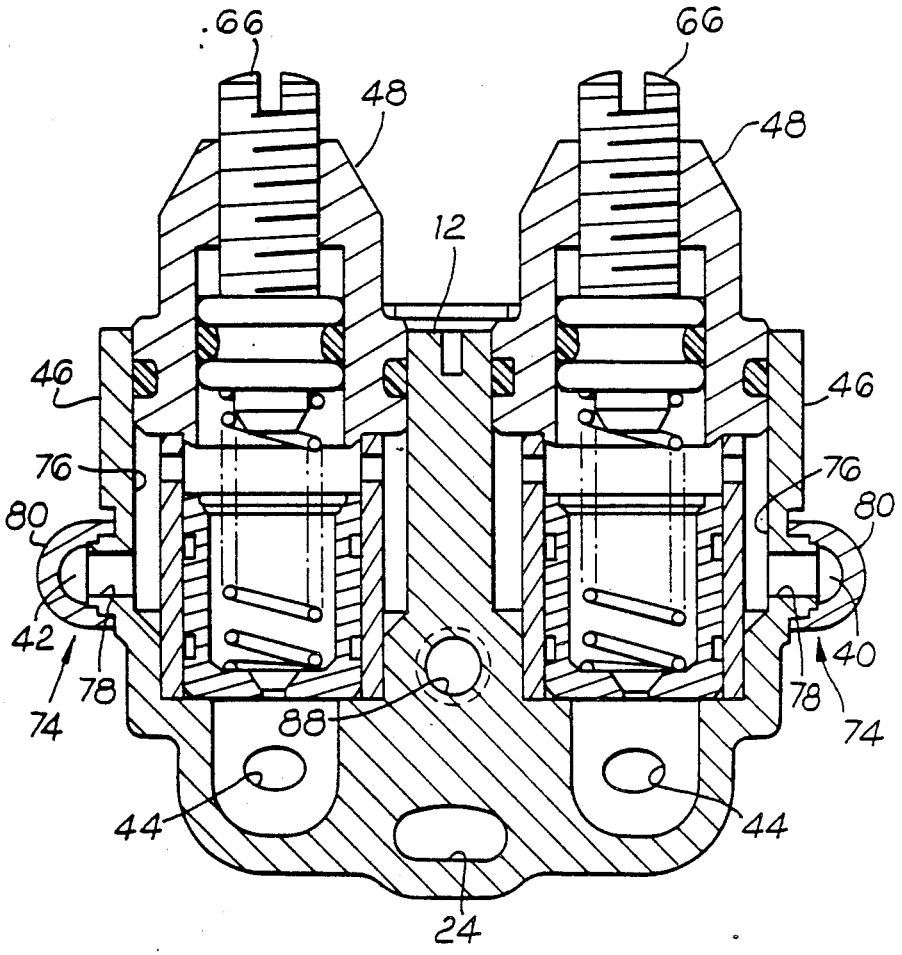
FIG. 7 is an elevational sectioned view of the structure of FIG. 1 through lines VII—VII.
Figure 8:
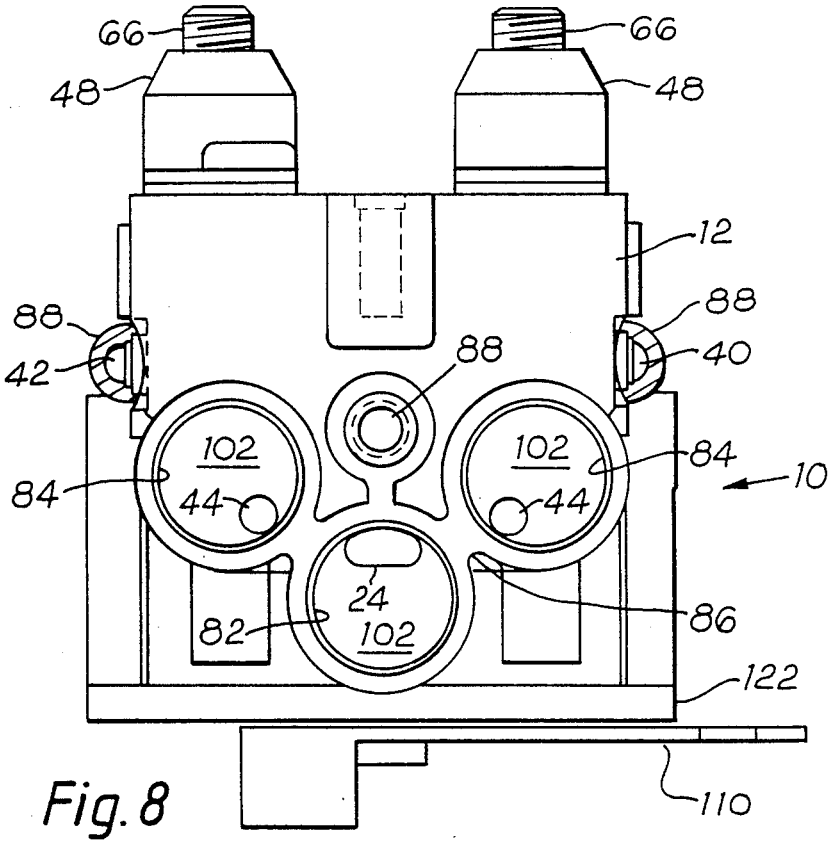
FIG. 8 is a rear elevational view of the structure of FIG. 1.
Figure 10:
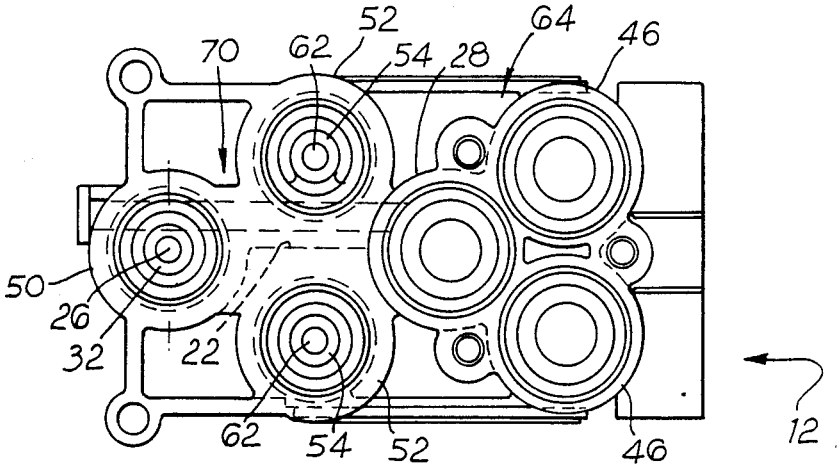
FIG. 10 is a top plan view of the valve body of the structure of FIG. 1.
Figure 11:
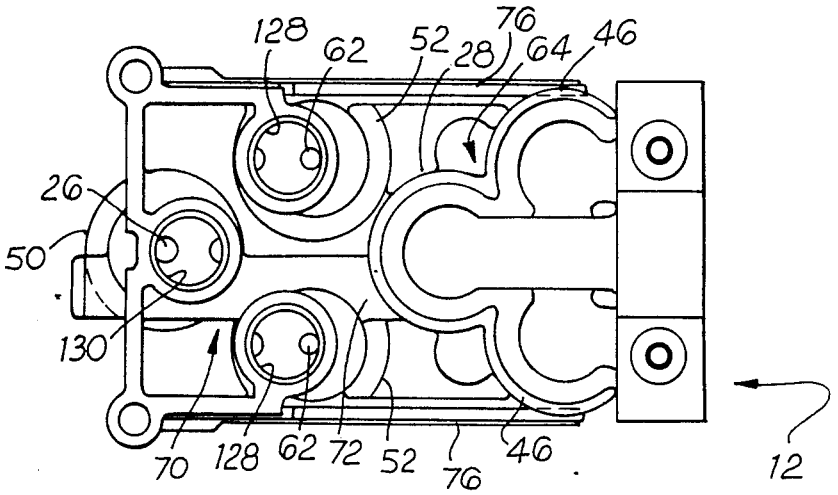
FIG. 11 is a bottom plan view of the structure of FIG. 10.
Figure 12:
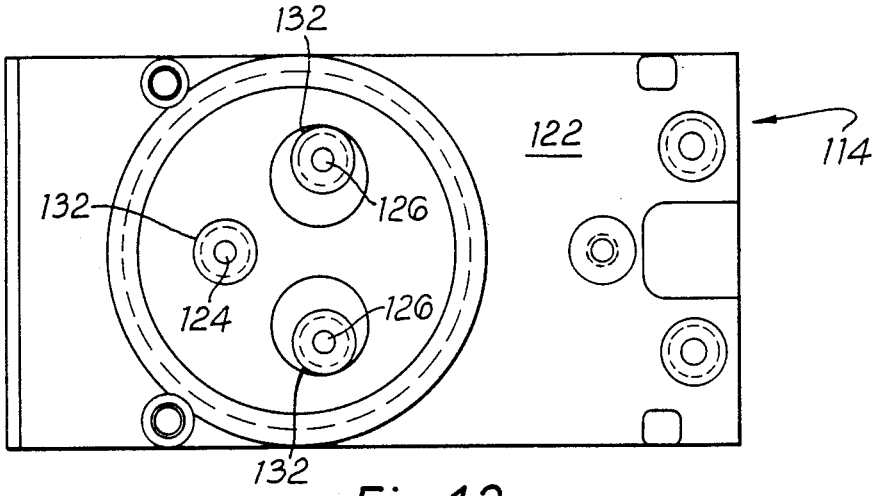
FIG. 12 is a top plan view of the bottom cover of the structure of FIG. 1.
Figure 13:
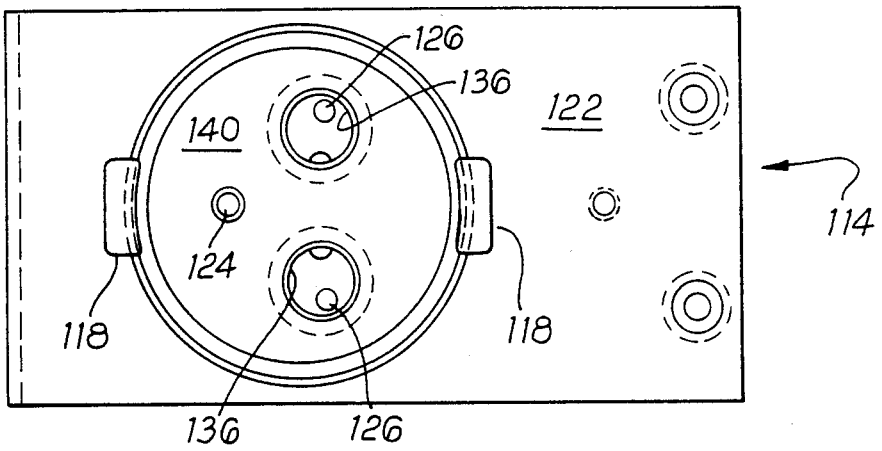
FIG. 13 is a bottom plan view of the structure of FIG. 12.
Figure 14:
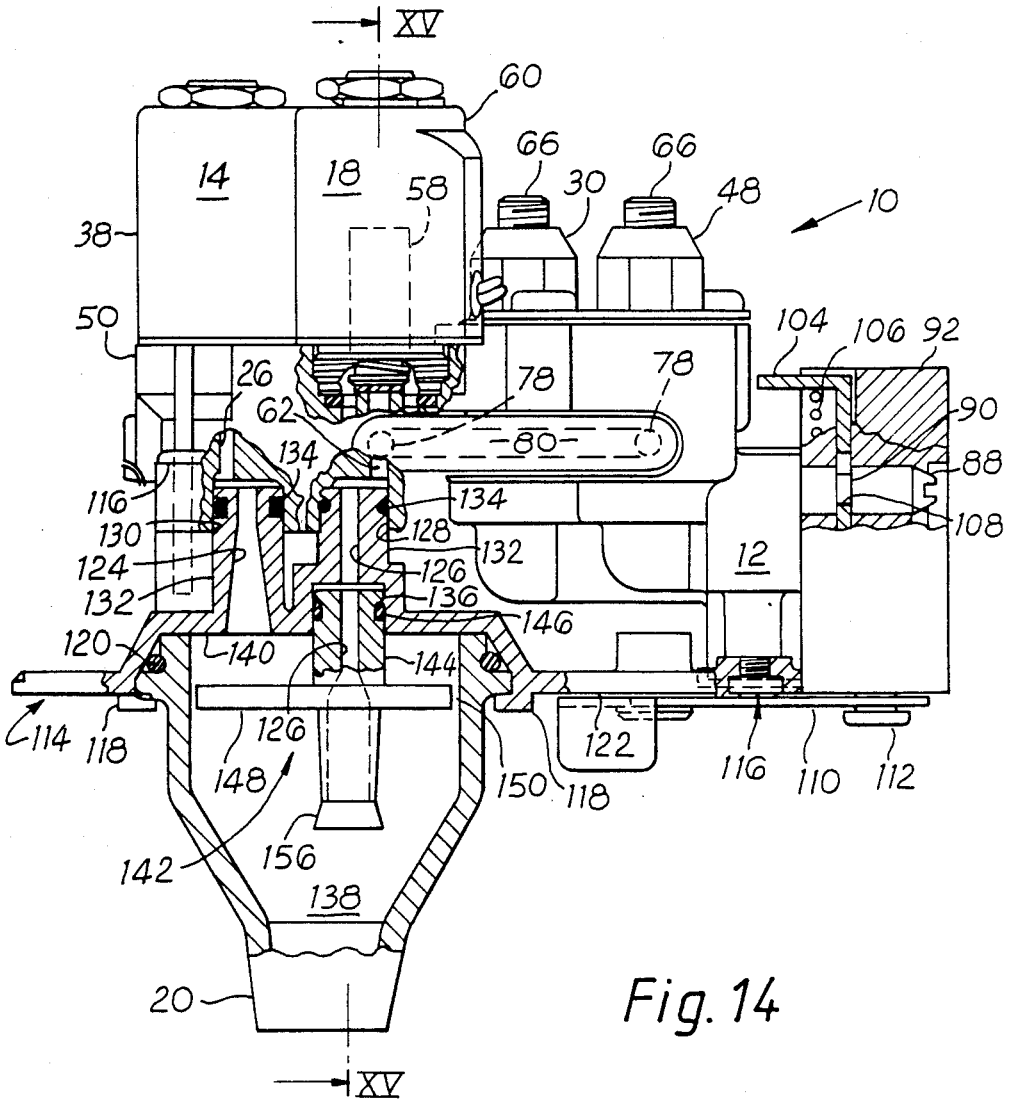
FIG. 14 is a side elevational view, in partial section, of the structure of FIG. 1.

The structure of valve body 12 per se is clearly shown in plan in FIGS. 10 & 11 wherein all componentry other than the tunnel covers 80 has been removed to clarify the illustration. The structure of the valve body 12 through the syrup flow control housings 46 is clearly shown in section in FIG. 7.

Figure 9:
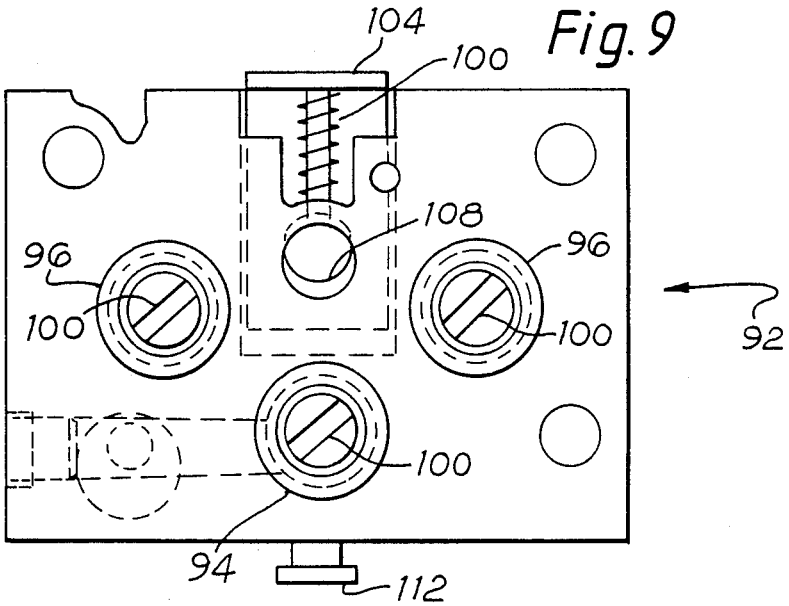
FIG. 9 is a front elevational view of the mounting block of the structure of FIG. 1.

The back or inlet end of the valve body 12 is clearly shown in FIG. 9. The water inlet 24 fluidly extends into a water inlet journal 82 on the center-line and adjacent to the bottom of the valve body 12. Each syrup inlet 44 fluidly extends into a respective syrup inlet journal 84. The pair of syrup journals 84 are above and transversely straddle the water inlet journal 82 forming an isosceles triangular shaped inlet structure 86. A guide pin 88 is mounted on the vertical center-line of the valve body 12 in line with and above the water inlet journal 82, and preferably above the horizontal center-line of the syrup inlet journals 84. The guide pin 88 extends rearward out from the back side of the valve body 12 and has a lock abutment 90.

A discrete mounting block is shown in FIG. 9 and generally indicated by the numeral 92. The block 92 is fixedly secured to a dispenser (not shown) and the valve body 12 is then repeatedly connected to and disconnected from the block 92 for cleaning, service, replacement and so forth. The block 92 has a water outlet 94 and a pair of syrup outlets 96 that register with and insert into the water and syrup journals 82, 84 respectively. The water outlet 94 is normally fluidly connected to a conventional source of cold carbonated water (not shown) and the syrup outlets 96 are normally connected to conventional and discrete source of different syrups (not shown). Each block outlet 94, 96 has a seal 98 and a normally closed (NC) poppet valve 100 that is opened by an abutment 102 in the respective inlet journal 82, 84 when the valve body 12 and block 92 are fluidly connected and mechanically locked to each other. A sliding push button lock 104 has a spring 106 that biases a lock surface 108 into locking engagement with the guide pin abutment 90 to lock the valve body 12 to the block 92. The lock 104 is pushed down to unlock and release the valve body 12 from the block 92. On the underside of the valve body 12 and block 92, and below the water inlet journal 82, is a second and lower rotatably mounted locking latch 110 that manually rotates and hooks onto and latches and locks to lock pin 112 on the block 92 to positively secure the body 12 to the block 92, and to secure the body 12 so the body 12 is vertically stable on the block 92.

The underside of the valve body 12 is covered by a generally planar bottom cover, generally indicated by the number 114 which is held to the valve body 12 by fasteners 116. The nozzle 12 is fastened to the bottom cover 114 by partial turn bayonet fasteners 118 and sealed by an o-ring 120. The nozzle 12 comes off with a partial turn, and is re-installed and locked to the bottom cover 114 with a partial turn.

A generally planar bottom skirt 122 surrounds the nozzle 12 and covers and encloses the bottom side of the valve body 12. The bottom cover 114 has a generally vertical water outlet port 124 that projects up and seals to the valve body water outlet 26. The bottom cover 114 also has a pair of discrete generally vertical and discrete syrup outlet ports 126 that extend up and seal to the valve body syrup outlets 62. Each valve body syrup outlet 62 leads into a syrup outlet journal 128 that is eccentric from the respective syrup outlet 62 and which is located convergently toward the body water outlet 26 from the body syrup outlet 62. The body water outlet 26 leads into a water outlet journal 130 that is eccentric from the water outlet 26 in a direction forward and convergently toward the body syrup outlets 62. Each cover water and syrup outlet 124, 126 is in an outlet tube 132 having a seal 134 between itself and the respective body outlet journals 128, 130.

The cover syrup outlet ports 126 lead to eccentrically positioned cover syrup journals 136 which are convergently positioned toward each other and the cover water outlet 124.

Figure 15:
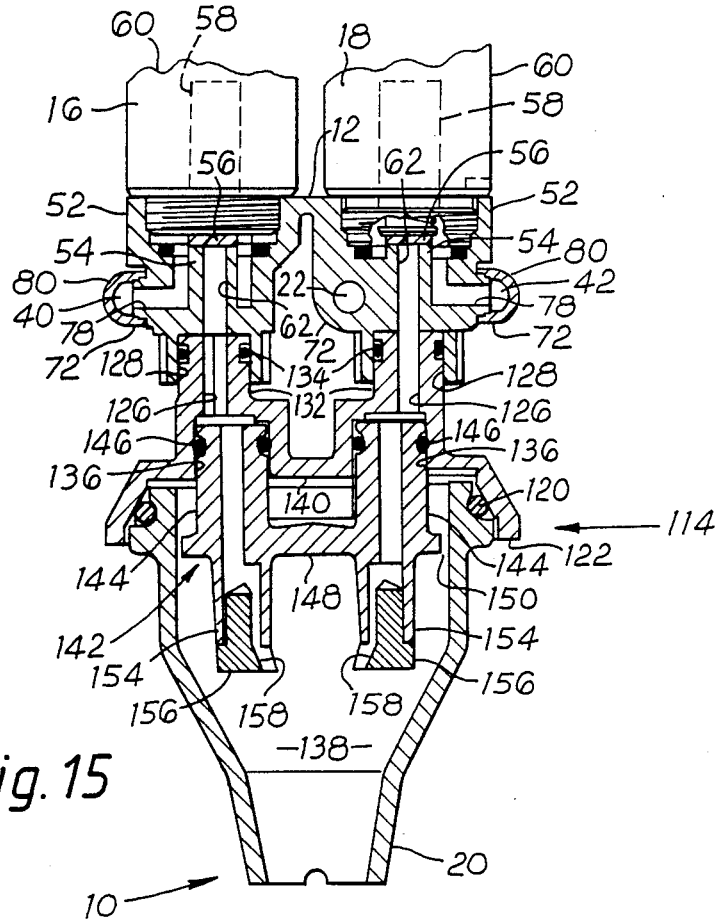
FIG. 15 is a front elevational view through the structure of FIG. 14 through lines XV—XV.
Figure 16:
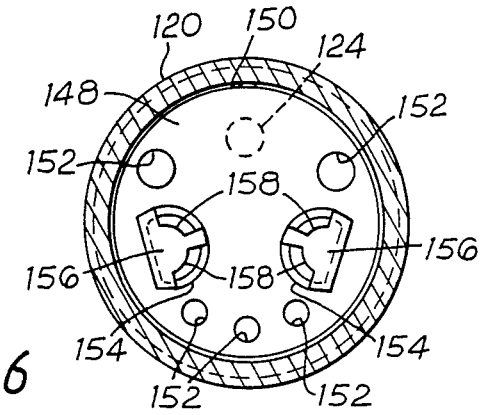
FIG. 16 is an upward looking plan view of the structure in FIG. 14.

Within a mixing chamber 138 jointly defined by the nozzle 12 and mix chamber upper surface roof 140 in the bottom cover 114, is a generally H-shaped mixing member 142 as best seen in FIG. 15. The mixing member 142 has a pair of spaced apart upstanding syrup tubes 144 that extend into the cover syrup journals 136 and have seals 146 therein. The tubes 144 extend through an integral diametric carbonated water diffusion disc 148 providing an annular water passageway 150 between itself and the nozzle 12 and a plurality of water apertures 152 which are not aligned with the cover water outlet 124. Extending downward from each mix member syrup tube 144 is an outlet end 154 of each syrup port 40, 42. Each outlet end 154 has a generally D-shaped cross section as best seen in FIG. 16. A generally D-shaped syrup diffuser 156, as also best seen in FIG. 16 is at each syrup outlet end 154. In both the outlet ends 154 and the diffusers 156, the flat side of the D-shape is fluidly closed and backed up against an inner surface of the nozzle 12, and a pair of syrup deflector surfaces 158 face towards and across the center of the nozzle 12. Each deflector surface 158 is focused to spray syrup in a fan shaped spray below the other deflector surface 158 and into the tube of water flowing on the inside of the nozzle 12. Each syrup deflector 156 is keyed into and secured to a respective syrup outlet end 154. The fan spray of syrup deflected from each deflector surface 158 intersects with water falling through each and every water aperture 152 during dispensing. The dispensing valve solenoids 38, 60 are electrically energized for dispensing by selective operation of one of two or three dispensing actuator switches 160.

This multiple flavor post-mix beverage dispensing head 10 is economically viable, relatively easy to manufacture, is sanitary, is reliable and of relatively simple construction, offers quick disconnect mounting, and provides excellent dispensing performance.

Although other advantages may be found and realized and various modifications may be suggested by those versed in the art, it should be understood that we wish to embody within the scope of the patent warranted hereon, all such embodiments as reasonably and properly come within the scope of our contribution to the art.

We claim as our invention:

1. A multiple flavor post-mix beverage dispensing head comprising (a) a valve body having a water inlet, a pair of discrete syrup inlets, a water port from the water inlet to a water outlet, a pair of discrete syrup ports which discretely lead to a pair of discrete and spaced apart syrup outlets, and a valve seat in each port;

(b) a normally closed valve element on each valve seat and a discrete solenoid for each valve element, each solenoid being mounted on top of the body;

(c) a single mixing nozzle under the water outlet and both of the syrup outlets; with (d) said water and syrup outlets, said water and syrup valve seats, said water and syrup valves, and said solenoids all being in a triangular structure above the nozzle.

2. The beverage dispensing head of claim 1, including:

a water flow rate control mounted in the body and fluidly in the water port, a pair of discrete syrup flow rate controls mounted in the body and one each fluidly in a respective syrup port, said flow rate controls being mounted on the top of said body immediately behind the solenoids, and being in a triangular structure nested into the triangular structure of the solenoids.

3. The beverage dispensing head of claim 2, in which the water solenoid and the water flow rate control are at the front of their respective triangular structures.

4. The beverage dispensing head of claim 2, in which the water valve, the water solenoid and the water flow control are in a fore-aft center-line of the body;

in which the syrup valves, the syrup solenoids and the syrup flow controls are split one each on each transverse side of the body;

in which the water port extends for and aft in the body, between the syrup flow controls with the syrup ports being spaced transversely from the water ports; and including a quick disconnect mounting block having self closing water and syrup disconnect valves sealed to the water and syrup inlets respectfully, said syrup inlets and disconnect valves being on a common horizontal plane and said water inlet and disconnect valve being vertically offset from said plane.

5. A multiple flavor post-mix beverage dispensing head comprising of:

(a) a valve body having a water inlet, at least two discrete syrup inlets, a water port from the water inlet to a water outlet, discrete syrup ports which lead from the syrup inlets to respective syrup outlets, and a valve seat in each port;

(b) a single nozzle underneath the water and syrup outlets; and (c) at least two of said ports being on the outside of said body and being enclosed and defined in port by initially discrete covers permanently welded to and made an integral part of the body.

6. The dispensing head of claim 5, in which the water port is transversely in between the covers.

7. The dispensing head of claim 6, in which the covers are on opposite sides of the valve body.

8. The dispensing head of claim 5, in which each cover extends from a body housing for a syrup flow rate control to a body housing for the respective syrup valve seat.

9. The dispensing head of claim 8, in which a portion of the body surrounding an elongate and fore-aft length of the water port forms a central fore-aft structural element of the valve body, and syrup port base plates and the covers jointly form side fore-aft structural elements of the valve body.

10. A multiple flavor post-mix beverage dispensing head, comprising:

(a) a valve body having a water inlet, a pair of discrete syrup inlets, a water port from the water inlet to a water outlet, and a pair of discrete syrup ports which discretely lead to a pair of discrete and spaced apart syrup outlets;

(b) a normally closed valve in each port, said valves being on top of said outlets;

(c) a bottom cover mounted to said body, said cover having (1) a generally planar bottom skirt covering an underside of the body, (2) generally vertical discrete water and syrup outlet ports fluidly connected to the respective water and syrup outlets of the body, and (3) nozzle securing structure;

(d) outlet seals fluid tightly sealing the cover outlet ports to the body outlets;

(e) a mixing nozzle secured to said bottom cover by said securing structures, said water and syrup outlet ports converging from the body to the nozzle; and (f) outlet journals in said body accepting cover outlet tubes of said cover therein, said outlet tubes having a cover portion of the outlet ports and said outlet seals therein, and in which said body has an uppermost portion of said outlet ports, said outlet journals and said cover outlet tubes and said cover portion of the outlet ports being convergently eccentric from the uppermost portions of said outlet ports.

11. The dispensing head of claim 10, including lower syrup tubes sealed to the bottom of said cover outlet tubes, said syrup tubes and lowermost portions of the syrup outlet ports in said syrup tubes being convergently eccentric from said cover outlet tubes.

12. The dispensing head of claim 10 wherein said bottom cover has a mix chamber roof above the nozzle and the syrup outlets, said water outlet opening into the nozzle at said mix chamber roof.

13. In a multiple flavor post-mix beverage dispensing head having a body, a water valve fluidly connectible to a source of water, at least two discrete syrup valves individually fluidly connectible to discrete sources of discrete syrups, a single mixing nozzle, and a water outlet port from the water valve to the nozzle, the improvement comprising:

(a) a pair of generally vertical syrup outlet ports, said ports extending downwardly into the nozzle and being off center within the nozzle;
(b) a syrup diffuser at the outlet end of each syrup port;
(c) a syrup deflector surface on each diffuser, each deflector surface being focused toward a far side of the nozzle; and in which
(d) said outlet ports are extended through syrup tubes integrally mounted to a water diffusion disc, said disc and syrup tubes being in an H-shape.

14. The improvement of claim 13, in which said syrup outlets are in a triangular arrangement with a mix chamber water outlet, said syrup outlets being spaced about the chamber water outlet.

15. The improvement of claim 13, in which each deflector surface is focused so that syrup is sprayed below the other deflector surface.

16. The improvement of claim 13, in which each diffuser is generally D-shaped with the flat side of the D-shape being backed up against an inner surface of the nozzle, and with the syrup deflector surface being on the rounded side of the D-shape.

17. In a post-mix beverage dispensing head having a body, a water valve fluidly connectible to a source of water, a syrup valve fluidly connectible to a source of syrup, a mixing nozzle and a water outlet into the nozzle, an improved syrup diffuser within the nozzle and having:

(a) a generally vertical syrup outlet port having downward facing outlet end;
(b) a syrup diffuser plug at the outlet port;
(c) outwardly sloped syrup deflector surfaces on said plug and below the level of the outlet port, said outlet end and said deflector surfaces forming a syrup outlet into the mix nozzle; wherein
(d) said syrup outlet port is within and through a syrup tube extending through a disc shaped water diffusion disc, said diffuser plug being welded to said syrup tube.

18. The improvement of claim 17, wherein said tube is generally D-shaped, and said diffuser is generally D-shaped and is radially indexed into the syrup tube.

19. A multiple flavor post-mix beverage dispensing head comprising:

(a) a valve body having a water inlet and a water port extending from the inlet to a water outlet, a pair of discrete syrup inlets and a pair of discrete syrup ports extending from the respective syrup inlets to respective syrup outlets; said syrup inlets being on a common horizontal plane and said water inlet being positioned between said syrup inlets and vertically spaced from said horizontal plane;
(b) a normally closed valve in each of the ports;
(c) a single mixing nozzle under the water and syrup outlets;
(d) a guide pin extending from a back side of the valve body, said pin being above said horizontal plane and having a lock abutment;
(e) a quick disconnect mounting block removably secured to the back side of the body, said block having:
  (1) a complementary water outlet and a pair of syrup outlets fluid tightly sealed to the respective water and syrup inlets of the body;
  (2) a normally closed disconnect valve in each block outlet, each disconnect valve being held open by an abutment in each respective inlet, and
  (3) a lock on the top side of the block engaging the pin abutment and locking the pin to the block; and
(f) means on the undersides of the head and underneath the valve body and the block for latching the body to the block.

20. In a multiple flavor post-mix beverage dispensing head having a body, a water valve fluidly connectible to a source of water, at least two discrete syrup valves individually fluidly connectible to discrete sources of discrete syrups, a single mixing nozzle, and a water outlet port from the water valve to the nozzle, the improvement comprising:

(a) a pair of generally vertical syrup outlet ports, said ports extending downwardly into the nozzle and being off center within the nozzle;
(b) a syrup diffuser at the outlet end of each syrup port;
(c) a syrup deflector surface on each diffuser, each deflector surface being focused toward a far side of the nozzle; and in which
(d) said diffusers are initially discrete components welded into syrup tubes forming the syrup ports.

* * * * *